US005793350A

United States Patent [19]

Chandavarkar et al.

[11] Patent Number: 5,793,350

[45] Date of Patent: Aug. 11, 1998

[54] APPARATUS AND METHOD FOR ADAPTIVE IMAGE STRETCHING

[75] Inventors: Dinesh D. Chandavarkar, Cupertino; Mel Walter Eatherington, San Jose, both of Calif.

[73] Assignee: Chips & Technologies, Inc., San Jose, Calif.

[21] Appl. No.: 752,475

[22] Filed: Nov. 19, 1996

[51] Int. Cl.[6] ..... G09G 5/00; G09G 5/26

[52] U.S. Cl. ..... 345/130; 345/127

[58] Field of Search ..... 345/127–133, 345/3, 428, 433, 438, 439; 382/298–300, 47; 348/446, 581

[56] References Cited

U.S. PATENT DOCUMENTS

| | | | |
|---|---|---|---|
| 4,821,031 | 4/1989 | Roberts | 345/127 |
| 5,097,518 | 3/1992 | Scott et al. | 382/47 |
| 5,113,455 | 5/1992 | Scott | 382/47 |
| 5,285,192 | 2/1994 | Johary et al. | 345/132 |
| 5,351,064 | 9/1994 | Zenda | 345/130 |
| 5,363,119 | 11/1994 | Snyder et al. | 345/131 |
| 5,521,614 | 5/1996 | Kotha et al. | 345/128 |
| 5,682,170 | 10/1997 | Kotha et al. | 345/3 |
| 5,701,138 | 12/1997 | Othmer et al. | 345/132 |

*Primary Examiner*—Jeffery Brier
*Assistant Examiner*—David L. Lewis
*Attorney, Agent, or Firm*—D'Alessandro & Ritchie

[57] ABSTRACT

The invention pertains to the adaptive vertical stretching of an original image so that the resulting stretched image optimally fits within the vertical boundary of a display having a fixed number of pixel lines. A line replication state machine provides the stretching of the original image, while a line replication generator preferably generates new line replication numbers by sequentially incrementing an initial line replication number in an integer by integer fashion. A display image measuring device provides a display fit status to the state machine, enabling the state machine to determine whether a resulting stretched image fits within the display exceeded the vertical height of the display. The state machine toggles between two types of line stretching that gives a stretched image closely fitted to the maximum image size available in an applicable display. Toggling between the two types of line stretching enables the state machine to create stretched images that are more precisely fitted to the vertical size of the display, and provides "fractional" line replication although the line replication numbers used are integers.

22 Claims, 3 Drawing Sheets

APPARATUS AND METHOD FOR ADAPTIVE IMAGE STRETCHING

BACKGROUND OF THE INVENTION

1. Field of the Invention

The present invention relates to an apparatus and method for converting an image of a given resolution to fit within a display that supports images of higher resolution. More particularly, this invention relates to the method and apparatus for adaptively stretching an image vertically, resulting in a stretched image that optimally fits within a panel-like display.

2. The Background of the Invention

Stretching a VGA graphics image to fit within a display supporting resolutions beyond that of VGA and having a fixed scanning resolution, e.g., a flat panel display, are known in the art. For example, one method calculates the amount of line replication needed to stretch the VGA graphics image based on the image's current height and the display panel height. This method uses BIOS to calculate the line replication number and one of the BIOS extended registers to pass the value to a graphics controller. The value enables the graphics controller to stretch the original VGA image to a size based on the value passed. Specifically, the value enables the graphics controller to determine which scan line of the original VGA image to replicate and the number of times that scan line portion is to be replicated. For example, a line replication number of 2 signifies that the original VGA image is to be stretched by replicating every third scan line of the image once.

Calculation of the line replication number and the storing of the value into a line replication register is initiated by BIOS, i.e., firmware, each time there is a system boot or whenever a VGA display mode change occurs. Recalculation of the line replication number during a mode change is required since there are more than one VGA display mode available with each display mode resulting in a different VGA image height for any given image.

As known in the art, BIOS calculates the line replication number by determining the image height of the image to be displayed and subtracting from it the value representing the height of the panel. The result is used to divide the height of the original image, and the quotient is then rounded to the lowest integer value and typically decremented by one. The resulting integer value is then designated as the line replication number.

For example, an original VGA image having a vertical height of 200 scan lines for display within a panel-like display having a panel height of 300 scan lines would result in a line replication number of one (1). As outlined above, this line replication number is obtained by subtracting the image height, 200 scan lines, from the panel height, 300 scan lines, resulting in 100 scan lines. The image height is then divided by the result of 100 scan lines, resulting in a quotient of two that is then decremented by 1. This results in a line replication number of 1, resulting in the replication of every second scan line of the original image by 1 which gives a stretched image having a vertical height of 300 scan lines.

For purposes of this disclosure, a panel-like display may be any class of display means having a fixed pixel resolution, i.e., a display that has a fixed number of pixel lines upon which scan lines may be rasterized. For example, for maximum display resolution, a panel-like display provides one pixel line for every scan line that comprises an image. One such panel-like display may be a flat panel display such as that found in portable computers and laptops, as commonly known in the art. Also, for the remainder of the following disclosure both the original VGA image height and the display height will be expressed in pixel lines as the unit of measure.

The above method of calculating a line replication number using BIOS and storing the line replication number in an extended register programmed by BIOS is not supported in all computer configurations because not all BIOS provide a line replication register, e.g., IBM BIOS. Thus, in order for image stretching to occur for all available VGA display modes, a given graphics controller must be supported with the BIOS used. Otherwise, maximum stretching of the original VGA image can only be achieved for at most one VGA mode.

The 65550 integrated circuit by Chips & Technologies of San Jose, Calif. provides a solution to the limitations of the BIOS driven line replication approach discussed above. The 65550 integrated circuit adaptively stretches an image using hardware to generate line replication numbers without requiring any additional BIOS register programming. The use of the 65550 integrated circuit to perform line replication with the use of a physical register to hold an initial line replication value avoids the uncertainty of compatibility brought on by varying BIOS implementations, and thus, enables image stretching to occur for all available VGA display modes for a wide variety of graphics controllers.

However, the 65550 integrated circuit uses an image stretching scheme that provides a limited number of stretched image sizes since it relies on line replication numbers that vary or differ only by discrete integer intervals. This results in a progression of increasingly smaller image sizes that have sufficient size differences even between concurrent line replication numbers. For instance, using a line replication number of 0 to stretch an original image having a vertical height of 330 pixels results in a stretched image having a vertical height of 660 pixels. The stretched image would consequently be too large for a display having a vertical height of 600 pixels, e.g., a flat panel display that supports 800×600 pixel resolution. However, if the original image is stretched using the next available line replication number under the 65550 implementation, which is 1, the resulting stretched image would only have a vertical height of 495 pixels. This results in a less than an optimum fit within the display since a top and bottom border of about 52 pixels wide results between the top and bottom borders of the stretched image and the display.

OBJECTS AND ADVANTAGES OF THE INVENTION

Accordingly, it is an object of the present invention to provide an apparatus and method for adaptively stretching an original image vertically so that the resulting stretched image optimally fits within a display having a fixed number of pixel lines by providing fractional line number replication.

It is an object of the present invention to provide an apparatus and method for adaptively stretching an image for display in a display panel using hardware to calculate the line replication number without requiring any additional BIOS register programming.

It is further another object of the present invention to provide an apparatus and method for adaptively stretching an image for display in a panel display that is compatible with a large variety of graphics controllers and software regardless of the type of BIOS employed by a computer system.

These and many other objects and advantages of the present invention will become apparent to those of ordinary skill in the art from a consideration of the drawings and ensuing description of the invention.

SUMMARY OF THE INVENTION

In a presently preferred embodiment, the invention adaptively stretches an original image vertically so that the resulting stretched image optimally fits within a panel-like display. For this disclosure a panel-like display is a display that has a fixed number of pixel lines such as a flat panel LCD display and will hereinafter be referred to as a "display." A line replication state machine stretches the original image using "fractional" line replication, while a line replication generator preferably generates new line replication numbers by sequentially incrementing an initial line replication number in an integer by integer fashion.

The state machine provides fractional line replication by toggling between two types of line stretching. In the first type, the state machine uses each line replication number received from the line replication number generator as a stretching factor for all of the pixel lines comprising the original image. In the second type, the state machine alternates between a prior ("old") line replication number and a new line replication number as the stretching factors for the set of lines comprising the original image. Toggling between the two types of line stretching enables the state machine to create stretched images that are more precisely fitted to the vertical size of the display since although the line replication numbers are integers, the state machine can toggle between the integers so as to provide "fractional" line replication of the original image.

The vertical size of the stretched image created by the state machine is inversely proportional to the line number received. Consequently, since preferably the line replication generator successively increments each new line replication number or alternates between a prior and newly incremented line replication number, every additional stretched image created becomes progressively smaller in height until the stretched image height is equal to or is less than the display height.

A display image measuring device measures the vertical size of the resulting stretched image and sends a display fit status to the state machine each time a stretched image is completed. This enables the state machine to determine whether a stretched image exceeded the vertical height of the display. If so, the state machine creates a new stretched image that is slightly smaller than the previously stretched image.

In the presently preferred embodiment of the invention, the invention is implemented in hardware and has a set of registers that may be defined as extended registers in BIOS. This provides the invention with the advantages of being compatible with a large variety of graphics controllers and software regardless of the type of BIOS employed by a computer system, as well as having the capability to off-load the adaptive image stretching process from BIOS.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

The Apparatus

Figure 1:
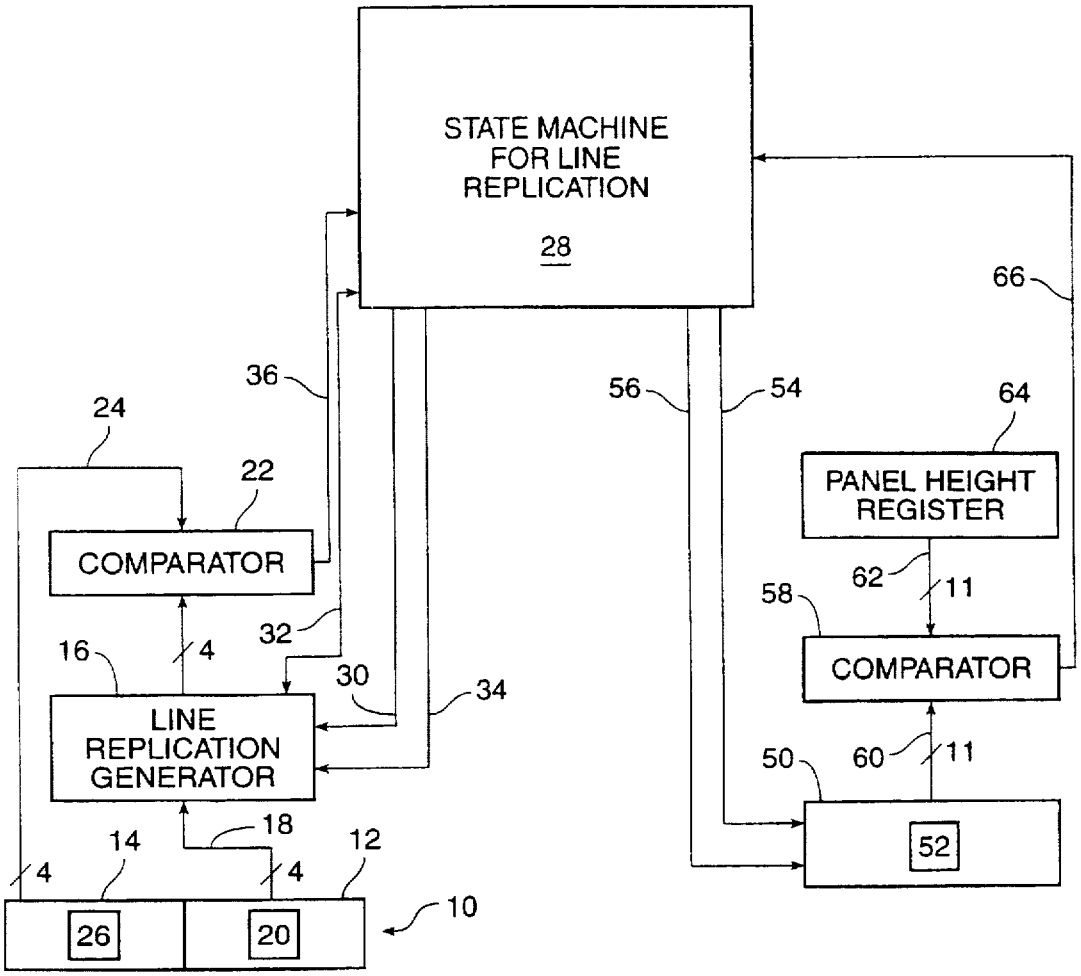
FIG. 1 is a block diagram of the presently preferred embodiment of the image stretching device using fractional line replication.

FIG. 1 is a block diagram of the presently preferred embodiment of the present invention.

In accordance with the presently preferred embodiment of the present invention, the invention includes a storage area 10 that has a lower bound portion 12 and an upper bound portion 14. Preferably, both the lower and upper bound portions 12, 14 are equal in width and are four bits wide but may be any size depending on the stored values used. For example, if 32 different levels of stretching are needed, then the lower and upper bound portions would each need to be five-bits wide. The storage area 10 is a register capable of storing the total combined width of the lower bound portion 12 and the upper bound portion 14. Consequently, an eight-bit register would comprise storage area 10 since both the lower and upper bound portions 12, 14 are each four-bits wide.

The lower bound portion 12 connects to a line replication number generator 16 via a bus 18 for transferring an initial replication value 20 while the upper bound portion 14 connects to a comparator 22 via a bus 24 and holds an replication limit value 26. The line replication number generator 16, buses 18 and 24, and comparator 22 each have widths suitable for receiving the values stored in either the lower bound portion 12 or the upper bound portion 14, as known in the art.

In the preferred embodiment of the present invention, the line replication number generator 16 increments the initial replication value 20 to the next successive integer value, i.e., a newly incremented value, each time the line number generator 16 is triggered by the state machine. The value of the line replication number determines the vertical size of the stretched image generated by the state machine. The line replication number generator 16 provides a line replication number belonging within a set of line replication numbers having a progression that begins from the initial replication value 20 and ends with the replication limit value 26.

During every system initialization or mode change, the initial replication value loaded into the lower bound portion 12 is a zero (0). For example, if the initial replication value 20 is zero, the next integer value available in the progression is 1 although the initial replication value may be any value designating an initial line replication number. A line replication number of 0 results in the replication of every scan line comprising the image to be stretched, resulting in an image size approximately 2.0 times that of the original image. A line replication number of one (1) results in a single replication of every other scan line comprising the image to be stretched, resulting in an image size approximately 1.50 times that of the original image. Using a line replication number of three (3) results in the line replication of every third pixel line, resulting in an image size approximately 1.33 times that of the original image. Thus, the higher the line replication number used by the state machine the less the original image is stretched.

The present invention is not necessarily limited to such a progression of line replication numbers. For instance, the present invention may include a set of line replication numbers having a progression that only includes even integers beginning from an initial replication value of 0 and ending with a replication limit value of 14, e.g., 0, 2, 4, 6, 8, 10, 12, 14. However, the preferred line replication number sequence always begins from low to high since image stretching size is inversely proportional to the magnitude of the line replication number received. This enables the state machine to adaptively generate stretched images that become progressively smaller until a stretch image is formed that fits within the height of the display.

The replication limit value limits the highest number that the initial replication value may be incremented. In the preferred embodiment, the replication limit value loaded in the upper bound portion during initialization or a mode change is fifteen. Thus, if the line replication number has been incremented to this initial replication limit value of fifteen, every sixteenth line is then replicated once, resulting in the minimum limit that an image may be stretched. Thus, the vertical size of the stretched image created by the state machine is inversely proportional to the line replication number received. As the line replication generator successively increments each new line replication number, every additional stretched image created becomes progressively smaller in height until the stretched image height is equal to or is less than the display height.

The replication limit value and the initial line replication value defined above are not intended to limit the various embodiments of the present invention but may vary depending on the features of the application software initiating a mode change. For example, the application software may use an initial line replication value of 2 rather than 0 to minimize the number of image stretches completed before finding a suitable size.

The line replication generator 16 accepts and stores the initial line replication value 20 stored in the lower bound portion 12 when a load command is received from a state machine 28 via a control bus 30. The line replication generator 16 also returns the most recently incremented line replication number to the state machine 28 via output line 32 when triggered by the state machine 28 via increment line 34. This newly incremented number is also stored within the line replication generator so that the number may be successively incremented. In the preferred embodiment, the line replication generator follows a "n=n+1" increment algorithm.

In the presently preferred embodiment of the invention, the line replication generator 16 is a four-bit counter but may be any device capable of incrementing the value stored in the lower bound portion 12. The size of the line replication generator 16 is not intended in any way to be limiting but may be any size that is capable of incrementing between the upper and lower bound values loaded. For example, if the lower bound value is zero and the upper bound value is 32, then a five-bit binary counter would be required to increment from zero to thirty-one, inclusive.

The comparator 22 receives the initial replication number 20 or a newly incremented line replication number from the line replication generator 16 and compares that value with the line replication limit value 26 received from the upper bound portion 14. The comparator 22 also has a bus 36 connected to the state machine 28 for indicating whether the value received from the line replication generator 16 is greater than the replication limit value that was received from the upper bound portion 14.

In the presently preferred embodiment of the present invention, the state machine toggles between two types of line stretching. In the first type, the state machine uses each line replication number received from the line replication number generator as a stretching factor for all of the lines comprising the original image. In the second type, the state machine alternates between a prior ("old") line replication number and a new line replication number as the stretching factors for the set of lines comprising the original image. Toggling between the two types of line stretching enables the state machine to create stretched images that are more precisely fitted to the vertical size of the display since although the line replication numbers are integers, the state machine can toggle between the integers so as to provide "fractional" line replication of the original image.

Referring again to FIG. 1, a display line counter 50 tracks and stores the current height 52 of a stretched image in pixels as the image is being displayed. Preferably, both the display line counter 50 and the height of the stretched image 52 held by the counter 50 are eleven bits wide but other arrangements are contemplated. The current height 52 is initialized to the value of zero and loaded by the state machine 28 via bus 54 into the counter 50 and is incremented by the display line counter 50 when an increment signal is received from the state machine 28 via increment signal bus 56. In turn, each increment signal sent by the state machine is triggered each time a new line of pixels is displayed. After the current height 52 is incremented, the display line counter 50 sends that current height value 52 to an image size comparator 58 via 11 bit-wide bus 60 for comparison with the value held in a panel height register 64. The image size comparator 58 compares the value stored in panel height register 64 with the current height 52 value received from the display line counter 50.

Also, a status bus 66 is coupled to the image size comparator 58 and to the state machine 28, sending a signal representing the result of each compare operation. In the preferred embodiment of the present invention, a result that the value in the display line counter is less than or is equal to the value stored in the panel height register indicates that the stretched image as displayed is smaller than or equal to the panel height, i.e., the video controller has displayed a maximally stretched image for the given display panel.

Implementation—System View

Figure 2:
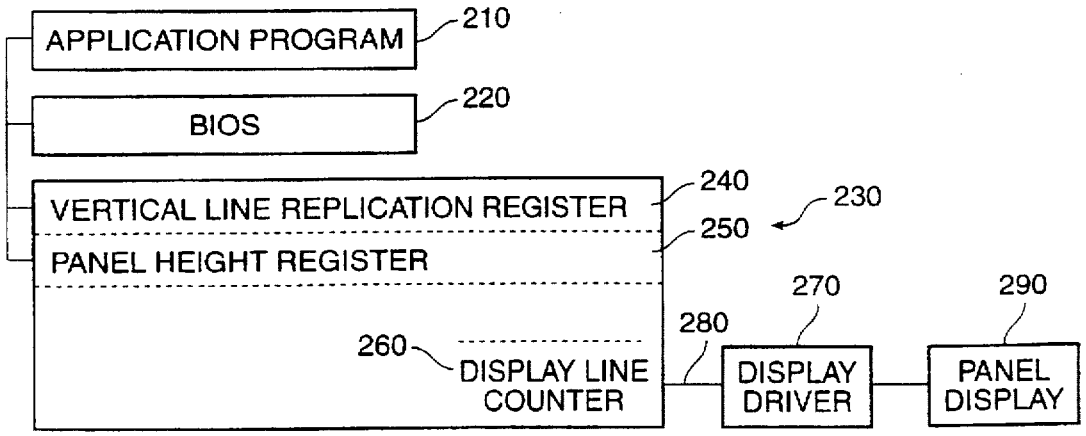
FIG. 2 is a block diagram of the preferred embodiment of the image stretching device coupled to a computer system.

FIG. 2 is a block diagram of the preferred embodiment of the image stretching device coupled to a computer system.

An application program 210 is coupled to the system BIOS 220 and the BIOS 220 is coupled to the image stretching apparatus 230, as shown. The image stretching apparatus includes the storage area 240 ("vertical line replication register") and the panel height register 250 which are defined as extended registers in the BIOS 220, while the display line counter 260 is coupled to a display driver 270. The display line counter to display drive coupling 280 permits the display line counter 260 to track from top to bottom the number of pixel lines sent to a panel display 290 during image stretching.

Sequence of Operation

Figure 3:
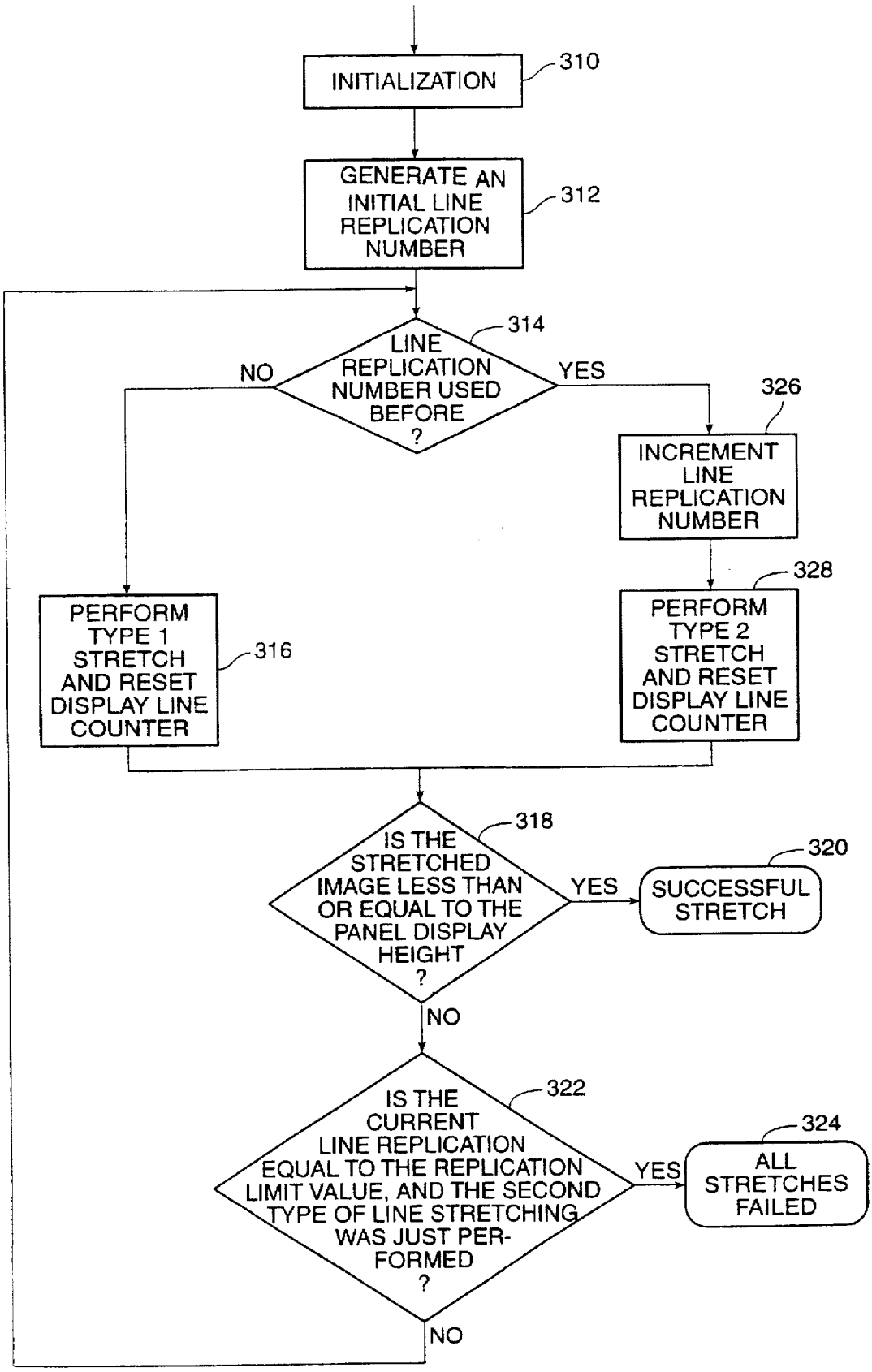
FIG. 3 is a flowchart for the preferred method of adaptively stretching an image using fractional line replication.

FIG. 3 is a flowchart for the preferred method of generating a line replication number for adaptively stretching an image for panel displays.

In the preferred embodiment of the present invention, the invention initiates image stretching each time a system initialization is performed or when a standard VGA register, CR 12 (not shown), is changed. As commonly known, VGA register CR 12 is updated whenever a mode change is requested by an application program. This register updating is used by the invention to determine when to initiate adaptive image stretching.

Beginning at step 310, the state machine is initialized. The panel height register 64 receives the height of the panel display in pixels from BIOS. Step 310 also includes loading the initial replication value 20 and the replication limit value 26 into the storage area 10, i.e., the vertical line replication register. Preferably, the initial replication value 20 is four bits wide and has a beginning value of 0, while the replication limit value 26 is also four bits wide and has a beginning value of fifteen. Those of the ordinary skill in the art with appreciate that these values are not intended to be in any way limiting but are listed merely to illustratively provide the minimum and maximum line replication numbers that are most applicable to the greatest variety of VGA image height sizes available for stretching.

At step 312, the line replication number generator provides an initial line replication number when the line replication generator 16 receives a load signal from the state machine. The line replication number generator provides the initial line replication number by obtaining the initial replication value 20 from the lower bound portion of the storage area, storing the value, and passing the value into the state machine.

At step 314, the state machine determines whether the current line replication number has been previously used in a stretching operation. If not, the present invention stretches the original image using the first type of line stretching by proceeding to step 316.

At step 316, the state machine stretches the image by using the first type of line stretching by repeating each (n+1)th line of the original image. For example, if the initial replication value is 0, then the state machine designates that value as the current line replication number, resulting in the replication of every line of the original image during image stretching.

After replication, the state machine sends a load command to the display line counter 50, initializing the display line counter 50. For example, the display line counter is loaded with an initialization value of zero (0). The state machine 28 also stores the received line replication number for use in the event that the state machine is required to perform the second type of line replication. The present invention then proceeds to step 318.

At step 318, the current line replication number is checked as to whether it has been previously used. Step 318 includes a display fit test that is initiated by comparing the height of the stretched image with the panel height. If the height of the newly stretched image is less than or equal to the panel height value then the process proceeds to step 320.

The display fit test step includes the display line counter counting every pixel line of the stretched image that is sent for display and sending the current pixel count value to the image size comparator 58. The image size comparator then compares the height of the newly stretched image as represented by the pixel count value with the panel height as stored in a panel height register. If the height of the newly stretched image is less than or equal to the panel height then the comparator sends a signal to the state machine that in turn terminates the stretching algorithm.

Note that the frame generation of the resulting stretched image begins from the top of the display panel and ends at the bottom of the display At step 320, the comparator sends a signal to the state machine which indicates that the initial stretching process did not result in an image that was too large for the display. The stretch was successful, i.e., the original image was maximally stretched but remained within the vertical boundary of the display panel. Consequently, the present invention terminates the stretching process after the stretched image is displayed.

If, at step 318, it was determined that the height of the newly stretched image is greater than the panel height value then the process proceeds to step 322.

At step 322, the current line replication number is checked if it is equal to the replication limit value and the second type of image stretching was just performed. Specifically, the comparator 22 compares the current line replication number with the upper bound value 26 and sends the result of the compare to the state machine. If the comparator 22 provides a result that the current line replication number is equal to the replication limit value; and the previous image stretch was of the second type, then the process proceeds to step 324.

At step 324, the stretching process is terminated since the adaptive image stretching process failed to generate a stretched image having a vertical image height less than or equal to the display panel height. Specifically, the comparator sends a signal to the state machine to indicate that the line replication number has been incremented beyond the upper bound value. The stretching process has resulted in a stretched image that exceeds the pixel height of the panel even at a line replication number providing the smallest line replication magnitude available. Consequently, the state machine terminates the stretching process by exiting from the image stretching process. Otherwise, the process loops back to step 314.

The present invention loops back to step 314 in order to refresh the frame with a slightly smaller stretched image since the height of the newly stretched image was found to be greater than the display panel height in previous step 322.

If, at step 314, it was determined that the line replication number has been used before, the process proceeds to step 326. At step 326, the state machine triggers the line replication number generator to create and send to the state machine a newly incremented line replication number. In response, the line replication generator 16 increments the previous line replication number, stores the number, and sends the newly incremented line replication number to the state machine 28 and the comparator 22. In accordance with the preferred embodiment of the present invention, the line replication number generator provides newly incremented line replication numbers that are within an n=n+1 progression.

This step also includes the state machine storing the newly incremented line replication number and designating that number as the current line replication number. The state machine 28 also resets the eleven bit display line counter by reloading the display line counter 50 with an. initialization value of zero. The state machine then proceeds to step 328.

At step 328, the state machine stretches the image using the second type of line stretching described above. The state machine alternates between the prior previously stored ("old") line replication number and the newly incremented line replication number received from the line replication generator 16 to perform image stretching. This results in a fractional line replication of the original image using alternating line replication numbers.

For example, if the previous line replication number was 0, the newly incremented line replication number would be an integer 1. Consequently, the first line of pixels comprising the original image is replicated once. At the second line of pixels comprising the original image, the state machine 28 toggles to the newly incremented line replication number which would be an integer 1. Because a line replication number of 1 results in replicating every other line, the third line of pixels comprising the original image is replicated rather than the second line of pixels. In effect, this results in repeating every (n+2)th line, counting from the last pixel line replicated from the original image.

Fractional Line Replication

Figure 4:
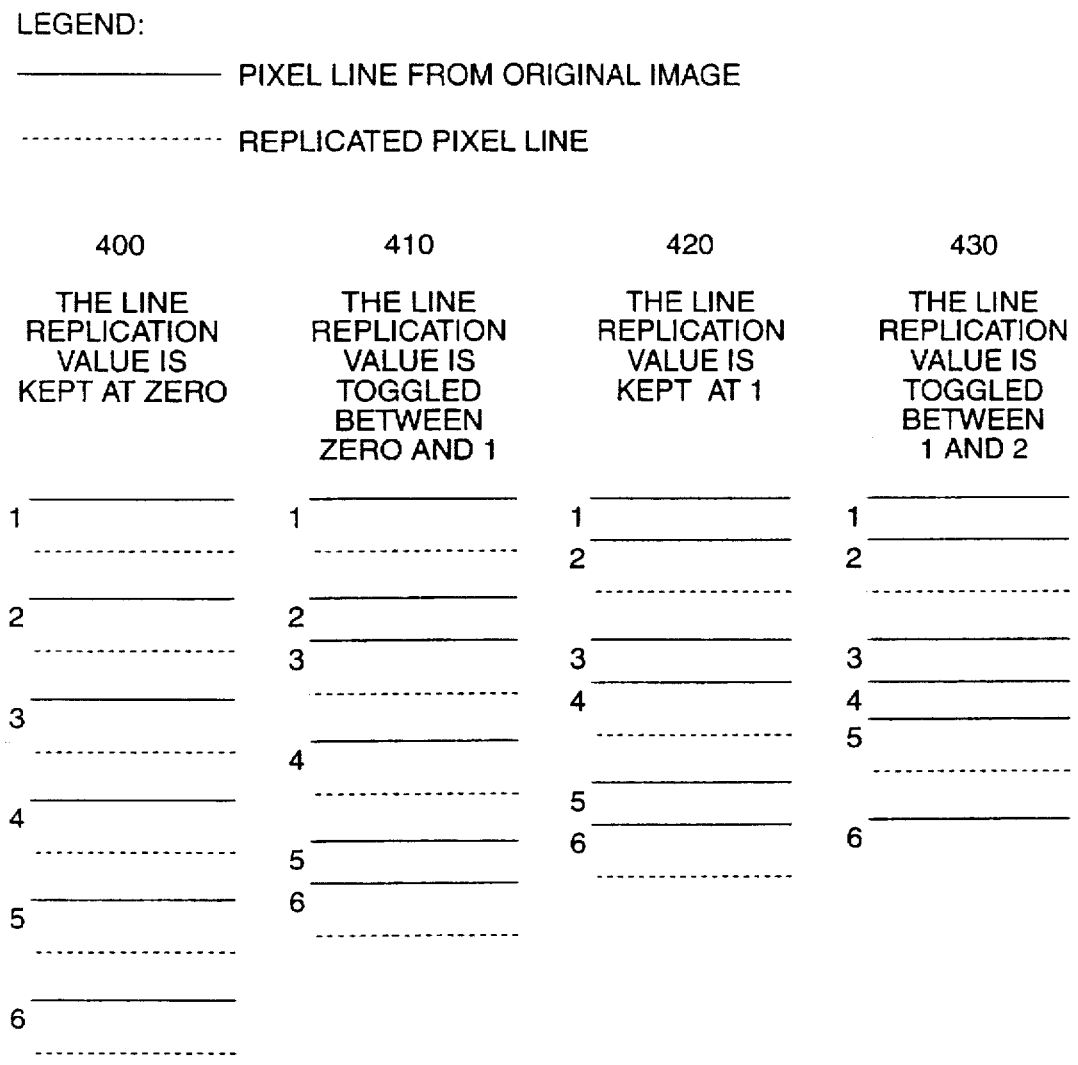
FIG. 4 is a diagrammatic representation of stretched images that result using the fractional line replication approach described as the presently preferred method of practicing the invention.

FIG. 4 is a diagrammatic representation of stretched images created using the fractional line replication approach described as the presently preferred method of practicing the invention. More particularly, FIG. 4 shows diagrammatically stretched images that result when the state machine toggles between the two types of line replication discussed above. Pixel lines from the original image are shown as solid lines, and replicated pixel lines are shown as dashed lines.

FIG. 4, first column 400 represents the line replication of pixel lines 1–6 that comprise part of an original image when the present invention uses the first type of line replication. Beginning with an initial line replication number of 0, a stretched image results where every pixel line comprising the original image is replicated. This results in a stretched image having 2.0 times the number of pixel lines than that of the original image.

FIG. 4, second column 410 shows the result when the present invention uses the second type of line replication where it alternates between two line replication numbers, which in this example are 0 and 1. The line replication of pixel lines 1–6 that comprise part of an original image begins with the line replication number of 0. This results in the first pixel line of the original image being replicated once. The present invention then alternates to the line replication number of 1, resulting in the third pixel line of the original image beginning from the last pixel line counted being replicated once. This gives a resulting stretched image having a vertical size that is approximately 1.66 times the vertical size of the original image.

FIG. 4, third column 420 represents the line replication of pixel lines 1–6 that comprise part of an original image where the present invention toggles back to the first type of line replication, and thus, solely uses the next available line replication number in the sequence, which in this example is 1. A line replication number of 1 results in the replication of every third pixel line relative to the last line counted. Thus, every second line of pixels comprising the original image relative to the last line counted is replicated once. This gives a resulting stretched image having a vertical size that is approximately 1.5 times the vertical size of the original image.

FIG. 4, fourth column 430 again shows the fractional line replication feature of the present invention that includes alternating between two line replication numbers, which in the current sequence are 1 and 2. The line replication of pixel lines 1–6 that comprise part of an original image begins with a line replication number of 1. This results in the replication of every third pixel line beginning from the last line counted that comprises the original image, as shown and as described above. The present invention then alternates to a line replication number of 2. A line replication number of 2 results in the line replication of every third pixel line relative to the last pixel line counted. Consequently, alternating between the line replication numbers of 1 and 2 gives a stretched image having a vertical size that is approximately 1.4 times the vertical size of the original image.

Note that the use of line replication numbers between 0 through 2, inclusive is not intended in any way to limit the present invention to these set of numbers but are used to simplify the description of the present invention.

Note also that while illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. An apparatus for stretching an image comprising:

a display size register for storing a display size;

an initial line replication number register for storing an initial line replication number n;

a maximum line replication number register for storing a maximum line replication number;

means for loading an initial value of n into said initial line replication number register;

first means for forming a stretched image by repeating each (n+1)th line of said image;

second means for forming a stretched image by alternating between repeating each (n+1)th line of said image, counting from the last line replicated in said image and repeating (n+2)th line, counting from the last line replicated in said image; and control means for repeatedly and selectively enabling one of said first means for forming a stretched image and said second means for forming a stretched image, for comparing the size of the stretched image with the contents of the display size register, and for incrementing n until said stretched image fits within said display or until the contents of said maximum line replication number register equals n and said second means for forming a stretched image was just previously used.

2. The apparatus of claim 1, wherein said control means includes:

a first counter for incrementing said line replication number n;

a first comparator for comparing said size of the stretched image with the contents of said display size register; and a second comparator for comparing a line replication number n with said maximum line replication number.

3. The apparatus of claim 2, wherein said first comparator compares the contents of a second counter with the size of said stretched image and said display size register.

4. The apparatus of claim 2, wherein said first counter increments said line replication number n by 1.

5. The apparatus of claim 2, wherein said first counter increments said line replication number n by an integer greater than 1.

6. An apparatus for vertically stretching an image, comprising:

a line replication state machine for stretching the image, said state machine including a device for toggling between a first type of line replication and a second type of line replication;

a generator coupled to said state machine for providing said line replication number; and a display image measuring means coupled to said line replication state machine for tracking the vertical size of a stretched image and providing a display fit status to the line replication state machine, wherein said line replication state machine has a line replication storage area for storing an old line replication number, said state machine using only one line replication number in said first type of line replication, and said state machine alternating between said old line replication number and a newly incremented line replication number in said second type of line replication.

7. The apparatus of claim 6, wherein said generator uses an initial replication value as said new line replication number for a first image stretch or said generator creates a new line replication number from said initial replication value after said first image stretch, and said apparatus further comprising:

a first storage area coupled to said generator and having said initial replication value and a replication limit value;

a first means for comparing said replication limit value from said first storage area and said new line replication number from said generator; and a second means for comparing a panel height value and said vertical size of said stretched image, said second means coupled to said display image measuring means and to said line replication state machine.

8. The apparatus of claim 7, wherein said generator includes a first counter for receiving said initial replication value from said storage area and for providing said line replication number to said state machine, and said display image measuring means includes a second counter for providing said tracking of said vertical size of said stretched image.

9. The apparatus of claim 7, wherein said first means for comparing includes a first comparator and said second means for comparing includes a second comparator.

10. A method for stretching an image for a display comprising the steps of:

providing a line replication number n;

determining whether said line replication number n was previously used;

creating a stretched image by repeating each (n+1)th line in said image and comparing the number of lines in said stretched image to the line size of said display if said line replication number n was not previously used;

sending said stretched image to said display if the number of lines in said stretched image is less than or equal to the line size of said display and comparing the line replication number n with a maximum line replication number if the number of lines in said stretched image is greater than the line size of said display;

if the number of lines in said stretched image is greater than the panel display height indicating a failed video stretch attempt if the line replication number n is equal to a predetermined maximum line replication number and said stretched image was created by alternating between repeating each (n+1)th line once, counting from the last line replicated in said image, and repeating each (n+2) line once, counting from the last line replicated in said image, and then comparing the number of lines in said stretched image to the line size of said display;

incrementing said line replication number n and creating a stretched image by alternating between repeating each (n+1)th line once, counting from the last line replicated in said image, and repeating each (n+2) line once, counting from the last line replicated in said image, and then comparing the number of lines in said stretched image to the line size of said display if said line replication number n was previously used; and repeating the steps of determining, creating, sending, indicating, and incrementing until the occurrence of either sending said stretched image to said display or indicating a failed video stretch attempt.

11. The method of claim 10, wherein said incrementing step increments said line replication number n by 1.

12. The method of claim 10, wherein said incrementing step increments said line replication number n by an integer greater than 1.

13. A method for vertically stretching an image having a plurality of pixel lines, comprising the steps of:

storing a display panel height value in a panel height value register and storing a replication limit value in a first portion of a first register;

providing a line replication number n to a state machine each time said state machine requests said line replication number;

determining whether said line replication number n has been previously used in any prior line replication step;

creating a stretched image using a first type of line replication if said line replication number has been previously used in a prior line replication step, and otherwise using a second type of line replication, wherein said first type of line replication includes repeating each (n+1)th pixel line in said image to produce pixel lines comprising a stretched image, and wherein said second type of line replication includes incrementing line replication number n and alternating between repeating each (n+1)th line once, counting from the last line replicated in said image, and repeating each (n+2) line once, counting from the last line replicated in said image to produce pixel lines comprising a stretched image;

counting each pixel line of said stretched image resulting either from said first type of line replication or from said second type of line replication;

sending a success signal and ending the method of line replication if the number of said pixel lines comprising a stretched image is less than or equal to said stored display panel height value;

sending a failure signal and ending the method line replication if said line replication number is equal to said replication limit value and said second type of line replication was the type of line replication last used; and repeating said steps of providing, determining creating, counting, sending a success signal, and sending a failure signal until either said success signal or said failure signal is sent.

14. The method of claim 13, wherein:

said step of storing further includes storing an initial line replication value in a second portion of said first register;

said step of creating a stretched image using a first type of line replication further includes using each said provided line replication number as a stretching factor for the set of pixel lines comprising the image, and said step of creating a stretched image using a second type of line replication further includes alternating between a prior line replication number and a new line replication numbers as the stretching factors for said set of pixel lines comprising the image;

said step determining whether the number of said pixel lines comprising a stretched image is less than or equal to said stored display panel height value includes comparing said replication limit value from said first portion of said first register with said provided line replication number; and said step of determining whether said line replication number is equal to said replication limit value and said second type of line replication was the type of line replication last used includes comparing said panel height value and the vertical size of said stretched image.

15. The method of claim 13, wherein said step of sending a success signal includes the step of sending said stretched image to a display apparatus if the number of said pixel lines comprising a stretched image is less than or equal to said stored display panel height value.

16. A method for stretching an image for a display, comprising the steps of:

providing a line replication number n;

determining whether said line replication number n has been previously used in any prior line replication step;

creating a stretched image by repeating each (n+1)th line in said image if said line replication number n was not previously used;

creating a stretched image by alternating between repeating each (n+1)th line once, counting from the last line replicated in said image, and repeating each (n+2) line once, counting from the last line replicated in said image if said line replication number n was previously used;

comparing the number of lines in said stretched image to the line size of said display;

sending said stretched image to said display if the number of lines in said stretched image is less than or equal to the line size of said display and comparing the line replication number n with a maximum line replication number if the number of lines in said stretched image is greater than the line size of said display;

if the number of lines in said stretched image is greater than the panel display height indicating a failed video stretch attempt if the line replication number n is equal to a predetermined maximum line replication number and said stretched image was created by alternating between repeating each (n+1)th line once, counting from the last line replicated in said image, and repeating each (n+2) line once, counting from the last line replicated in said image, and then comparing the number of lines in said stretched image to the line size of said display; and incrementing said line replication number n and repeating the steps of determining, creating a stretched image if said line replication number was previously used, creating a stretched image if said line replication number was not previously used, comparing, sending, and indicating until the occurrence of either sending said stretched image to said display or indicating a failed video stretch attempt.

17. The method of claim 16, wherein said incrementing step increments said line replication number n by 1.

18. The method of claim 16, wherein said incrementing step increments said line replication number n by an integer greater than 1.

19. A method for stretching an image for a display, comprising the steps of:

providing a line replication number n;

determining whether said line replication number n has been previously used in any prior line replication step;

creating a stretched image by repeating each (n+1)th line in said image if said line replication number n was not previously used creating a stretched image by alternating between repeating each (n+1)th line once, counting from the last line replicated in said image, and repeating each (n+2) line once, counting from the last line replicated in said image if said line replication number n was previously used;

comparing the number of lines in said stretched image to the line size of said display;

sending said stretched image to said display if the number of lines in said stretched image is less than or equal to the line size of said display;

if the number of lines in said stretched image is greater than the panel display height indicating a failed video stretch attempt if the line replication number n is equal to a predetermined maximum line replication number and said stretched image was created by alternating between repeating each (n+1)th line once, counting from the last line replicated in said image, and repeating each (n+2) line once, counting from the last line replicated in said image, and then comparing the number of lines in said stretched image to the line size of said display; and decrementing said line replication number n and repeating the steps of determining, creating a stretched image if said line replication number was previously used, creating a stretched image if said line replication number was not previously used, comparing, sending, and indicating until either the number of lines in said stretched image is greater than the line size of said display or a failed video stretch attempt is indicated.

20. The method of claim 19, wherein said decrementing step decrements said line replication number n by 1.

21. The method of claim 19, wherein said decrementing step decrements said line replication number n by an integer greater than 1.

22. An apparatus for stretching an image comprising:

a display size register for storing a display size;

an initial line replication number register for storing an initial line replication number n;

a maximum line replication number register for storing a maximum line replication number;

means for loading an initial value of n into said initial line replication number register;

first means for forming a stretched image by repeating each (n+1)th line of said image;

second means for forming a stretched image by alternating between repeating each (n+1)th line of said image, counting from the last line replicated in said image and repeating (n+2)th line, counting from the last line replicated in said image; and control means for repeatedly and selectively enabling one of said first means for forming a stretched image and said second means for forming a stretched image, for comparing the size of the stretched image with the contents of the display size register, and for incrementing n until said stretched image fits within said display or until the contents of said maximum line replication number register equals n.

* * * * *